United States Patent [19]

Hwa et al.

[11] Patent Number: 4,649,025

[45] Date of Patent: Mar. 10, 1987

[54] ANTI-CORROSION COMPOSITION

[75] Inventors: Chih M. Hwa, Palatine; Wayne A. Mitchell, Crystal Lake, both of Ill.

[73] Assignee: W. R. Grace & Co., New York, N.Y.

[21] Appl. No.: 776,311

[22] Filed: Sep. 16, 1985

[51] Int. Cl.[4] ..... C23F 11/16

[52] U.S. Cl. ..... 422/15; 422/13; 252/180; 252/181; 252/389.22; 252/389.23

[58] Field of Search ..... 252/389.22, 389.23, 252/180, 181; 422/15, 13

[56] References Cited

U.S. PATENT DOCUMENTS

| | | | |
|---|---|---|---|
| 3,532,639 | 10/1970 | Hatch | 252/389.23 |
| 3,803,047 | 4/1974 | Hwa | 252/389.22 X |
| 3,803,048 | 4/1974 | Hwa | 252/389.22 |
| 3,933,427 | 1/1976 | Bohnsack et al. | 252/180 X |
| 3,935,125 | 1/1976 | Jacob | 252/389.21 X |
| 3,959,167 | 5/1976 | Hwa et al. | 252/180 |
| 3,959,168 | 5/1976 | Germscheid et al. | 252/389.22 X |
| 4,026,815 | 5/1977 | Kallfass et al. | 252/180 |
| 4,042,324 | 8/1977 | Auel et al. | 252/180 X |
| 4,052,160 | 10/1977 | Cook et al. | 422/15 |
| 4,101,441 | 7/1978 | Hwa et al. | 252/389 A |
| 4,159,946 | 7/1979 | Smith et al. | 252/180 X |
| 4,206,075 | 6/1980 | Boffardi | 252/389.22 |
| 4,265,769 | 5/1981 | Dingwall et al. | 210/699 |
| 4,276,089 | 6/1981 | Moran | 106/14.12 |
| 4,317,744 | 3/1982 | Levi | 252/389.22 |
| 4,351,796 | 9/1982 | Marshall | 252/389.2 X |
| 4,406,811 | 9/1983 | Christensen et al. | 252/180 |
| 4,409,121 | 10/1983 | Latos et al. | 252/389 A |

FOREIGN PATENT DOCUMENTS

| | | |
|---|---|---|
| 2084128 | 4/1982 | United Kingdom . |
| 2112370 | 7/1983 | United Kingdom . |

OTHER PUBLICATIONS

Research Disclosure 23229; Ciba-Geigy Plc; Aug., 1983.

*Primary Examiner*—Richard D. Lovering
*Assistant Examiner*—Matthew A. Thexton
*Attorney, Agent, or Firm*—David E. Heiser

[57] ABSTRACT

Composition for inhibition of ferrous metal corrosion consisting essentially of (a) HEDPA compound and (b) HPAA compound. Optionally the composition may also include (c) an azole.

11 Claims, No Drawings

ANTI-CORROSION COMPOSITION

The present invention relates to novel and improved corrosion inhibiting compositions and methods of inhibiting corrosion. The invention provides corrosion protection for metal parts such as heat exchangers, engine jackets and pipes; and reduces metal loss, pitting and tuberculation of iron base alloys which are in contact with water.

The invention is directed to a relatively non-toxic, non-chromate, non-zinc chlorine-stable corrosion inhibiting composition which is capable of protecting ferrous metals from corrosion; said composition consisting essentially of (a) HEDPA compound and (b) HPAA compound; optionally also (c) an azole. This mixture can be blended with any well known scale inhibitors or dispersants.

The prior art (Published UK Patent Application 2112370A) teaches the use of HPAA (i.e. hydroxyphosphonoacetic acid: $(HO)_2P(O)CH(OH)COOH$) or its water soluble salts as a corrosion inhibitor in aqueous systems. That published UK Patent Application also suggests the presence of other corrosion inhibitors such as acetodiphosphonic acid, nitrilo tris methylene phosphonic acid and methylamino dimethylene phosphonic acid; as well as benzotriazole, bis-benzotriazole or copper deactivating benzotriazole or tolutriazole derivatives (page 2, lines 13–25).

The use of HEDPA (i.e., hydroxyethylidene diphosphonic acid or 1-hydroxy ethane-1,1-disphosphonic acid) or its water soluble salts:

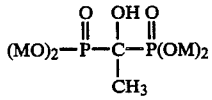

Where M equals hydrogen, alkali metal, alkaline earth metal, zinc, cobalt, lead, tin, nickel, ammonia, lower ($C_1$–$C_4$)alkyl or alkyl amine in corrosion inhibiting compositions is disclosed, interalia, by U.S. Pat. Nos. 4,101,441; 4,276,089; 4,406,811 and 4,409,121 and in U.K. Pat. No. 2084128B. The '441 patent discloses compositions comprising azole, soluble phosphate and an organo phosphonate such as HEDPA (see Examples 11, 12, 14 and 15). In '089 the composition includes relatively large amounts of high molecular weight (equal to or greater than 320) polyamine. In '811 the HEDPA is an optional additional ingredient in corrosion inhibiting compositions comprising triazole, mono- or di-carboxylic acid of 8–38 carbon atoms and non-ionic wetting agent. In the '121 patent the HEDPA is used in combination with a phosphate; a molybdate, tungstate or chromate and an aryl triazole. Mention is made (Column 4, lines 14–15) of the chlorine stability of HEDPA. The U.K. '128B patent teaches compositions comprising nitrite, organophosphonate (such as HEDPA) and optionally a water soluble polymer.

We have now discovered that the addition of a mixture of HEDPA and HPAA (or its or their water soluble salts or esters) alone or further in combination with an azole significantly improves the protection of ferrous metals in aqueous systems. Typical industrial applications where the instant invention is useful include water treatment, acid pickling, radiator coolant, hydraulic liquid, anti-freeze, heat transfer medium, and petroleum well treatment. An especially preferred application is in open recirculating cooling water systems.

Corrosion inhibiting compositions pursuant to the invention consist essentially from 5 to 95 percent by weight, based on the total weight of HEDPA compound plus HPAA compound, of an HEDPA compound having the general formula:

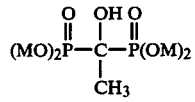

(I)

Wherein M is as specified above and, correspondingly, from 95 to 5 percent by weight, based on total weight of the two compounds, of an HPAA compound having the general formula:

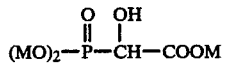

Wherein M, again, is as specified above.

Use of mixtures of any of the acids, salts or esters described above is also contemplated within the scope of this invention.

The compositions of this invention may also contain from 1 to 80 percent preferably from 2 to 40 percent and most preferably 3 to 20 percent by weight, based on total weight of the HEDPA and HPAA compounds, of an azole compound. Azoles are nitrogen containing heterocyclic 5-membered ring compounds. Azoles which are suitable in the composition of this invention include triazoles, pyrazoles, imidazoles, isoxazoles, oxazoles, isothiazoles, thiazoles and mixtures thereof as disclosed in U.S. Pat. Nos. 2,618,608, 2,742,369, and 2,941,953.

The triazoles which can be employed in the composition of this invention are water-soluble 1,2,3-triazoles such as 1,2,3-triazole itself or a substituted 1,2,3-triazole where the substitution takes place in either the 4 or 5 position (or both) of the triazole ring as shown here by the structural formula:

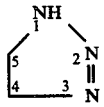

Suitable triazoles include benzotriazole; tolyltriazole (the preferred triazole); 4-phenyl-1,2,3-triazole; 1,2-naphthotriazole and 4-nitrobenzotriazole; and the like.

The pyrazoles which can be used in the composition of this invention include water-soluble pyrazoles such as pyrazole itself or a substituted pyrazole where the substitution takes place in the 3,4, or 5 position (or several of these positions) of the pyrazole ring as shown by the structural formula:

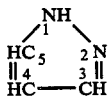

Suitable pyrazoles include pyrazole; 3,5-dimethyl pyrazole; 6-nitroindazole, 4-benzyl pyrazole; 4,5-dimethyl pyrazole; and 3-allyl pyrazole; and the like.

Imidazoles which can be used in the composition of this invention include water-soluble imidazoles such as imidazole itself or a substituted imidazole where the substitution takes place in the 2,4 or 5 position (or several of these positions) of the imidazole ring as shown here by the structural formula:

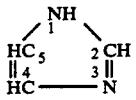

Suitable imidazoles which can be employed in the composition of this invention include imidazole; adenine; guanine; benzimidazole; 5-methyl benzimidazole; 2-phenyl imidazole; 2-benzyl imidazole; 4-allyl imidazole; 4-(betahydroxy ethyl)-imidazole; purine; 4-methyl imidazole; xanthine; hypoxanthine; 2-methyl imidazole; and the like.

Isoxazoles which can be employed in the composition of this invention include water-soluble isoxazoles such as isoxazole itself or a substituted isoxazole where the substitution takes place in the 3,4 or 5 position (or several of these positions) of the isoxazole ring as shown here by the structural formula:

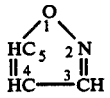

Suitable isoxazoles include isoxazole; 3-mercaptoisoxazole; 3-mercaptobenzisoxazole; benzisoxazole; and the like.

The oxazoles which can be employed in the composition of this invention include water-soluble oxazoles such as oxazole itself or a substituted oxazole where the substitution takes place in the 2,4 or 5 position (or several of these positions) of the oxazole ring as shown here by the structural formula:

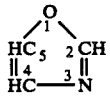

Suitable oxazoles include oxazole; 2-mercaptoxazole; 2-mercaptobenzoxazole; and the like.

The isothiazoles which can be employed in the compositions of this invention include water-soluble isothiazoles such as isothiazole itself or a substituted isothiazole where the substitution takes place in the 3, 4 or 5 position (or several of these positions) of the isothiazole ring as shown here by the structural formula:

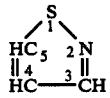

Suitable isothiazoles include isothiazole; 3-mercaptoisothiazole; 2-mercaptobenzisothiazole; benzisothiazole and the like.

The thiazoles which can be used in the composition of this invention include water-soluble thiazoles such as thiazole itself or a substituted thiazole where the substitution takes place in the 2, 4 or 5 position (or several of these positions) of the thiazole ring as shown here by the structural formula:

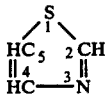

Suitable thiazoles include thiazole; 2-mercaptothiazole; 2-mercaptobenzothiazole; benzothiazole and the like.

In the above azole compounds, the constituents substituted in the azole rings can be alkyl, aryl, aralkyl, alkylol, and alkenyl radicals so long as the substituted azole is water-soluble. Typically, substituted members have from 1 to about 12 carbon atoms.

The method of this invention for inhibiting corrosion of ferrous metals in contact with aqueous systems comprises maintaining in the aqueous liquid from 0.1 to 50,000 parts per million ("ppm") preferably 1 to 1000 ppm and most preferably 5 to 200 ppm of the mixture of HEDPA compound with HPAA compound. When present, the further optional azole compound is maintained in the aqueous liquid in an amount of from 0.1 to 5000 ppm, preferably 0.2 to 1000 ppm and most preferably 0.4 to 50 ppm.

The composition of this invention can also contain dispersing agents, pH regulating agents, microbicides and the like.

The treatment composition employed in the process of this invention can be added to the water by conventional bypass feeder using briquettes containing the treatment, by adding the compounds either separately or together as dry powder mixtures to the water, or it can be fed as an aqueous feed solution containing the treatment components.

The organic phosphorous acid compounds employed in the composition and process of this invention exhibit unexpected stability in briquettes and solutions. Furthermore, substantially no degradation of the organic phoshorous acid components to orthophosphates occurs in the feed compositions and systems treated.

The compositions of this invention are non-toxic and prevent corrosion of ferrous metals in contact with aqueous liquids. These compositions can be substituted for chromate base corrosion inhibitors previously used where the toxicity of the chromate make its use undesirable or where disposal of corrosion inhibiting solutions containing chromates raises serious water pollution problems requiring extensive pretreatment to remove the chromates prior to disposal of such solutions. The compositions of this invention in aqueous solutions prevent corrosion of metal parts such as heat exchangers, engine jackets, and pipes and particularly prevent metal loss, pitting, and tuberculation of iron base alloys, copper alloys, and aluminum alloys in contact with water.

The invention is further illustrated by the following specific but non-limiting example.

EXAMPLE 1

This example demonstrates the synergistic reduction in corrosion rate obtained with the composition of this invention.

Test water solutions containing 12.5 ppm calcium chloride, 30.2 ppm calcium sulfate hemihydrate, 110.8 ppm magnesium sulfate heptahydrate and 176.2 ppm sodium bicarbonate were heated to 130° F. and pH was controlled at 8.0–8.5 using dilute $H_2SO_4$. Inhibitors were pretreated at 3 times the maintenance dosage (i.e., at the start up of the chemical treatment program the concentration of inhibitors was triple the subsequent normal (maintenance) dosage). Clean preweighed SAE 1010 mild steel test specimens (two for each in line test, two for main tank test; 4.5×0.5×0.05 inches) were immersed both in line (flow rate 2 ft/sec. past specimens) and in the main test tank (low flow) of a dynamic recirculating cooling water test rig. Make-up water (test water solution containing the maintenance dosage of inhibitors) was added to the system at a rate of 11 ml/min (8.7 liters system volume) and bleed off was also controlled at 11 ml/min. Each run covered a period of three days after which the steel coupons are removed, cleaned and reweighed to determine weight loss. Inhibitors present and steel corrosion rates in mils (thousandths of an inch) per year ("MPY") follow:

| Inhibitors & Dosage | | | | Corrosion Rate (MPY) | |
|---|---|---|---|---|---|
| Example | HPAA* | HEDPA** | Azole*** | Steel in Line | Steel in Tank |
| 1 | 0 ppm | 0 ppm | 0 ppm | 97.5 | 87.5 |
| 2 | 10 ppm | 0 ppm | 1.94 ppm | 3.2 | 8.1 |
| 3 | 0 ppm | 10 ppm | 1.94 ppm | 2.7 | 15.5 |
| 4 | 5 ppm | 5 ppm | 1.94 ppm | 2.4 | 5.6 |

*Hydroxyphosphonoacetic acid (active dosage)
**Hydroxyethylidene 1,1-diphosphonic acid (active dosage)
***Sodium tolyltriazole, 50% solution

We claim:

1. In a method of inhibiting corrosion in an aqueous system using at least one compound selected from the group consisting of hydroxyphosphonoacetic acid and its water-soluble salts, an improvement which comprises maintaining in the aqueous system at least one compound selected from the group consisting of hydroxyethylidene-1,1-diphosphonic acid and its water-soluble salts such that the amount of said hydroxyethylidene-1,1-diphosphonic acid component in the system is about equal to the amount of said hydroxyphosphonoacetic acid component in the system; maintaining in the aqueous system at least one azole such that the amount of azole component is about 10 percent by weight of the combined amount of said two acid components in the system; and maintaining the combined amount of said hydroxyethylidene-1,1-diphosphonic acid component and said hydroxyphosphonoacetic acid component in the system between 5 ppm and 200 ppm, to provide a mixture which significantly improves the protection of ferrous metals in the aqueous system.

2. A method according to claim 1 in which the azole component is selected from the group consisting of 1,2,3-triazole, benzotriazole, tolyltriazole, 4-phenyl-1,2,3-triazole, 1,2-napthotriazole, 4-nitrobenzotriazole, pyrazole, 3,5-dimethyl pyrazole, 6-nitroindazole, 4-benzyl pyrazole, 4,5-dimethyl pyrazole, 3-allyl pyrazole, imidazole, adenine, guanine, benzimidazole, 5-methyl benzimidazole, 2-phenyl imidazole, 2-benzyl imidazole, 4-allyl imidazole, 4-(betahydroxy ethyl)-imidazole, purine, 4-methyl imidazole, xanthine, hypoxanthine, 2-methyl imidazole, isoxazole, 3-mercaptoisoxazole, 3-mercaptobenzisoxazole, benzisoxazole, oxazole, 2-mercaptoxazole, 2-mercaptobenzoxazole, isothiazole, 3-mercaptoisothiazole, 2-mercaptobenzisothiazole, benzisothiazole, thiazole, 2-mercaptothiazole, 2-mercaptobenzothiazole, and benzothiazole.

3. A method according to claim 2 in which the azole is tolyltriazole.

4. A method according to claim 1 in which the concentration of the azole component in the system is from 0.4 to 50 ppm.

5. A method according to claim 4 in which the aqueous system is an open recirculating cooling water system.

6. Method according to claim 2 wherein the hydroxyphosphonoacetic acid component is selected from the group consisting of the free acid and the water soluble alkali metal, alkaline earth metal, zinc, cobalt, lead, tin, nickel, and ammonia salts of the phosphonic acid and carboxylic acid groups of hydroxyphosphonoacetic acid; and wherein the hydroxyethylidene-1,1-diphosphonic acid component is selected from the group consisting of the free acid and the water soluble alkali metal, alkaline earth metal, zinc, cobalt, lead, tin, nickel, and ammonia salts of the phosphonic acid groups of hydroxyethylidene-1,1-diphosphonic acid.

7. Composition for inhibiting corrosion of ferrous metal by aqueous liquid consisting essentially of at least one compound selected from the group consisting of hydroxyphosphonoacetic acid and its water-soluble salts, at least one compound selected from the group consisting of hydroxyethylidene-1,1-diphosphonic acid, and an azole; the amounts of said hydroxyphosphonoacetic acid component and said hydroxyethylidene-1,1-diphosphonic acid component being about equal; and the amount of azole component being about 10 percent by weight of the combined amount of said two acid components.

8. Composition according to claim 7 wherein the hydroxyphosphonoacetic acid component is selected from the group consisting of the free acid and the water soluble alkali metal, alkaline earth metal, zinc, cobalt, lead, tin, nickel, and ammonia salts of the phosphonic acid and its water soluble salts and carboxylic acid groups of hydroxyphosphonoacetic acid; and wherein the hydroxyethylidene-1,1-diphosphonic acid component is selected from the group consisting of the free acid and the water soluble alkali metal, alkaline earth metal, zinc, cobalt, lead, tin, nickel, and ammonia salts of the phosphonic acid groups of hydroxyethylidene-1,1-diphosphonic acid.

9. Composition according to claim 7 in which the azole component includes from 2 to 40 weight percent, based on total weight of the mixture of the hydroxyethylidene-1,1-diphosphonic acid component and the hydroxyphosphonoacetic acid component, of at least one azole selected from the group consisting of 1,2,3-triazole, benzotriazole, tolyltriazole, 4-phenyl-1,2,3-triazole, 1,2-napthotriazole, 4-nitrobenzotriazole, pyrazole, 3,5-dimethyl pyrazole, 6-nitroindazole, 4-benzyl pyrazole, 4,5-dimethyl pyrazole, 3-allyl pyrazole, imidazole, adenine, guanine, benzimidazole, 5-methyl benzimidazole, 2-phenyl imidazole, 2-benzyl imidazole, 4-allyl imidazole, 4-(betahydroxy ethyl)-imidazole, purine, 4-methyl imidazole, xanthine, hypoxanthine, 2-methyl imidazole, isoxazole, 3-mercaptoisoxazole, 3-mercaptobenzisoxazole, benzisoxazole, oxazole, 2-mercaptoxazole, 2-mercaptobenzoxazole, isothiazole, 3-mercaptoisothiazole, 2-mercaptobenzisothiazole, benzisothiazole, thiazole, 2-mercaptothiazole, 2-mercaptobenzothiazole, and benzothiazole.

10. Composition according to claim 9 wherein the azole is tolyltriazole.

11. Composition according to claim 10 consisting essentially of about 50 weight percent hydroxyethylidene diphosphonic acid about 50 weight percent hydroxyphosphonoacetic acid and about 10 weight percent sodium tolyltriazole based on the combined weight of said acids.

* * * * *